US007995001B2

(12) United States Patent
Ohmi et al.

(10) Patent No.: US 7,995,001 B2
(45) Date of Patent: Aug. 9, 2011

(54) ANTENNA FOR PORTABLE TERMINAL AND PORTABLE TERMINAL USING SAME

(75) Inventors: Tadahiro Ohmi, Miyagi (JP); Akihiro Morimoto, Miyagi (JP); Fumiaki Nakamura, Miyagi (JP)

(73) Assignee: Tadahiro Ohmi, Sendai-shi, Miyagi (JP)

( * ) Notice: Subject to any disclaimer, the term of this patent is extended or adjusted under 35 U.S.C. 154(b) by 0 days.

(21) Appl. No.: 10/546,191

(22) PCT Filed: Feb. 17, 2004

(86) PCT No.: PCT/JP2004/001677
§ 371 (c)(1),
(2), (4) Date: Oct. 27, 2005

(87) PCT Pub. No.: WO2004/075343
PCT Pub. Date: Sep. 2, 2004

(65) Prior Publication Data

US 2006/0119518 A1 Jun. 8, 2006

(30) Foreign Application Priority Data

Feb. 18, 2003 (JP) ..... 2003-040167

(51) Int. Cl.
*H01Q 15/00* (2006.01)

(52) U.S. Cl. ..... 343/911 R; 343/787

(58) Field of Classification Search ..... 343/700 MS, 343/911 R, 787
See application file for complete search history.

(56) References Cited

U.S. PATENT DOCUMENTS

| | | | | |
|---|---|---|---|---|
| 5,870,065 | A | 2/1999 | Kanaba et al. | |
| 5,933,116 | A | 8/1999 | Suesada et al. | |
| 6,033,782 | A * | 3/2000 | Hubbard et al. | 428/407 |
| 6,147,647 | A | 11/2000 | Tassoudji et al. | |
| 6,198,450 | B1 | 3/2001 | Adachi et al. | |
| 6,323,824 | B1 | 11/2001 | Heinrichs et al. | |
| 6,337,125 | B1 * | 1/2002 | Diaz et al. | 428/218 |
| 6,407,718 | B2 | 6/2002 | Adachi et al. | |
| 6,442,399 | B1 * | 8/2002 | Tsuru et al. | 455/575.7 |
| 6,452,565 | B1 | 9/2002 | Kingsley et al. | |
| 6,531,991 | B2 | 3/2003 | Adachi et al. | |

(Continued)

FOREIGN PATENT DOCUMENTS

DE 198 37 266 A1 2/2000

(Continued)

OTHER PUBLICATIONS

J. R. James et al., "Investigation of properties of electrical-small spherical ceramic antennas," Electronics Letters, IEE Stevenage, GB, vol. 38:20, Sep. 26, 2002, pp. 1160-1162, XP006018894.

(Continued)

*Primary Examiner* — Jacob Y Choi
*Assistant Examiner* — Robert Karacsony
(74) *Attorney, Agent, or Firm* — Foley & Lardner LLP

(57) ABSTRACT

A dielectric resonator antenna which emits an electric wave by having a dielectric body resonate is disclosed. A magnetic material is contained in the electric body, thereby increasing the relative permeability to more than 1 and lowering the relative permittivity. Consequently, the Q-value of the resonance can be lowered while maintaining the rate of wavelength shortening. With this technique, a broadband dielectric resonator antenna can be realized.

18 Claims, 10 Drawing Sheets

U.S. PATENT DOCUMENTS

| | | | | |
|---|---|---|---|---|
| 6,556,169 | B1 | 4/2003 | Fukuura et al. | |
| 6,639,559 | B2 * | 10/2003 | Okabe et al. | 343/700 MS |
| 6,653,986 | B2 | 11/2003 | Watada et al. | |
| 6,677,901 | B1 * | 1/2004 | Nalbandian | 343/700 MS |
| 6,816,118 | B2 * | 11/2004 | Kingsley et al. | 343/700 MS |
| 6,833,816 | B2 * | 12/2004 | Hilgers | 343/700 MS |
| 6,900,764 | B2 | 5/2005 | Kingsley et al. | |
| 2001/0054978 | A1 | 12/2001 | Adachi et al. | |
| 2002/0180646 | A1 * | 12/2002 | Kivekas et al. | 343/700 MS |
| 2003/0001781 | A1 * | 1/2003 | Konishi | 343/700 MS |
| 2003/0016176 | A1 | 1/2003 | Kingsley et al. | |
| 2003/0020657 | A1 * | 1/2003 | Sakamoto et al. | 343/700 MS |
| 2003/0142019 | A1 | 7/2003 | Hilgers | |

FOREIGN PATENT DOCUMENTS

| | | | |
|---|---|---|---|
| EP | 0982799 | A2 | 3/2000 |
| EP | 1209759 | A1 | 5/2002 |
| JP | 2554762 | A | 11/1991 |
| JP | 9-008541 | | 1/1997 |
| JP | 9-008542 | | 1/1997 |
| JP | 09-162625 | A | 6/1997 |
| JP | 09-326624 | A | 12/1997 |
| JP | 10-107537 | A | 4/1998 |
| JP | 10-247808 | A | 9/1998 |
| JP | 11-308039 | | 11/1999 |
| JP | 11-308039 | A | 11/1999 |
| JP | 2000-131126 | A | 1/2000 |
| JP | 2000-209019 | A | 7/2000 |
| JP | 2000-209020 | A | 7/2000 |
| JP | 2000-232317 | | 8/2000 |
| JP | 2000-232317 | A | 8/2000 |
| JP | 2000-332521 | A | 11/2000 |
| JP | 2001-024417 | A | 1/2001 |
| JP | 2001-144530 | | 5/2001 |
| JP | 2001-144530 | A | 5/2001 |
| JP | 3209045 | A | 7/2001 |
| JP | 2001-267840 | | 9/2001 |
| JP | 2001-267840 | A | 9/2001 |
| JP | 2001-313519 | | 11/2001 |
| JP | 2001-313519 | A | 11/2001 |
| JP | 3280204 | B2 | 2/2002 |
| JP | 2002-118410 | A | 4/2002 |
| JP | 2002-175921 | A | 6/2002 |
| JP | 3324340 | A | 7/2002 |
| JP | 2002-524954 | | 8/2002 |
| JP | 2002-524954 | A | 8/2002 |
| JP | 2002-271130 | A | 9/2002 |
| JP | 2002-330018 | A | 11/2002 |
| WO | WO 02/075851 | A1 | 9/2002 |

OTHER PUBLICATIONS

G. P. Junker et al., "Numerical Analysis of Dielectric Resonator Antennas Excited in Quasi-Te Modes," Electronics Letters, IEE Stevenage, GB, vol. 29:21, Oct. 14, 1993, pp. 1810-1811, XP000404297.

A. Popov et al., "Multi-mode dielectric resonator antenna with controllable radiation pattern," Antennas and Propagation Society, 1999, IEEE International Symposium, Orlando, FL, vol. 1, pp. 30-33, XP010348223.

A. Popov et al., "Evolution of 3D Radiation Patterns for a Multimode DRA," Proceedings of the International Symposium on Antennas and Propagation, vol. 1, Aug. 25, 2000, pp. 73-76, XP008071404.

* cited by examiner

ANTENNA FOR PORTABLE TERMINAL AND PORTABLE TERMINAL USING SAME

CROSS-REFERENCE TO RELATED PATENT APPLICATIONS

Japanese Application 2003-040167, filed Feb. 18, 2003 including the specification, drawings, claims and abstract, is incorporated herein by reference in its entirety. This application is a U.S. National Stage of PCT/JP2004/001677, filed Feb. 17, 2004, including the specification, drawings, claims and abstract, is incorporated herein by reference in its entirety.

TECHNICAL FIELD

This invention relates to an antenna for a portable terminal and a portable terminal including such an antenna.

BACKGROUND ART

As portable terminals of this type, various devices such as portable telephones and PDAs have been proposed and widely spread. Normally, radio devices each comprising a transmitter and a receiver are mounted in the portable terminals for performing data communications with databases or the like or voice communications by radio. In order to perform the radio communications, these portable terminals are essentially provided with antennas, respectively.

In this case, in order to enable reception even when the portable terminals are placed in any states, i.e. in order to ensure mobility of the portable terminals, the antennas of the portable terminals are normally nondirectional antennas. Therefore, as described above, these antennas are designed so as not to impede the advantages of the portable terminals, such as the mobility.

As the nondirectional antennas for the portable terminals, use has conventionally been made of quarter-wave grounded antennas. Further, as described in Japanese Patent (JP-B) No. 2554762 (Patent Document 1), there has been proposed an antenna having a structure of a combination of a quarter-wave grounded antenna and a helical antenna and thus contrived to exhibit excellent reception sensitivity both during communication and while on standby. The antennas of the portable terminals are each normally used for both transmission and reception.

Further, as antennas for miniaturizing the portable terminals, there are spreading dielectric resonator antennas each using a dielectric with a large permittivity to thereby utilize a wavelength shortening effect of shortening the wavelength to $1/\sqrt{(\epsilon\mu)}$.

In order to further miniaturize such dielectric resonator antennas, there are also those antennas each miniaturized by dividing in half the dielectric at an electric field symmetrical plane in a resonant state of a signal in the dielectric and contacting a divided surface thereof with a conductive plate or grounding it via an insulator to thereby utilize the mirror-image effect of an electric field by the conductive plate. These dielectric resonator antennas are also all nondirectional.

Japanese Unexamined Patent Application Publication (JP-A) No. H11-308039 (Patent Document 2), Japanese Unexamined Patent Application Publication (JP-A) No. 2000-209020 (Patent Document 3), and Japanese Unexamined Patent Application Publication (JP-A) No. 2000-209019 (Patent Document 4) disclose dielectric resonator antennas.

However, these Patent Documents 2, 3, and 4 each only propose the dielectric resonator antenna that can be improved in characteristics by using a dielectric having a high relative permittivity and improving the mounting and shape of the dielectric, but discuss nothing about improving a material of the dielectric forming the dielectric resonator antenna, or the like.

On the other hand, Japanese Unexamined Patent Application Publication (JP-A) No. H10-107537 (Patent Document 5) discloses a surface-mount type antenna having a radiation electrode, a feeding electrode, and a ground electrode formed on a substrate made of a dielectric, which radiates a radio wave by using capacitive coupling between the radiation electrode and the feeding electrode. This publication shows the surface-mount type antenna that can achieve desired characteristics even if there is variation in relative permittivity and relative permeability of the substrate and in electrode pattern.

However, this publication refers to nothing about a dielectric resonator antenna that emits an electromagnetic wave to the exterior by radiating a radio wave into a resonator formed by a dielectric so that the radiated radio wave resonates in the dielectric.

Here, the power most consumed in such portable terminals is transmission power including consumption power of the transmitters. As described before, the antennas of the portable terminals have the nondirectivity as radio wave radiation characteristics thereof for ensuring the mobility of the portable terminals. When the nondirectional antenna is used in this manner, since the portable terminal radiates a radio wave, i.e. transmits the power, in all directions including the directions where no base station exists, this serves as a cause of shortening the battery life in the portable terminal.

As a method for solving the foregoing problem, consideration is given to a method of transmitting the power only in a desired direction where the base station exists. By giving the directivity to the antenna of the portable terminal in this manner, it is possible to reduce the transmission power. By the use of the directional antenna, it is possible to realize the battery life that cannot be achieved by the technique using the conventional nondirectional antenna.

As the antenna that is capable of directional transmission, there is a phased array antenna, an adaptive array antenna, or the like. However, in order to use such an antenna, there arises a problem that since the antenna is designed with respect to a wavelength in the air, it cannot be mounted to a portable terminal or the like without miniaturizing the antenna itself.

In order to miniaturize the antenna itself, there is the method of using the dielectric resonator antenna as shown in the foregoing Patent Documents 2 to 4. For the miniaturization of the antenna, it is necessary to use a dielectric having a higher permittivity. There has arisen a problem that the change in impedance at a resonant frequency increases (the Q of the resonance increases) to narrow the band of the antenna.

Further, there has arisen a problem that when placing an antenna on a conductive plate and miniaturizing the antenna, since there is a high permittivity layer, forming a resonator, between an electrode and the conductive plate, the parasitic capacitance increases to narrow the band of the antenna.

When the band of the antenna is narrowed as described above, it is possible to broaden the band by performing matching by a matching circuit that serves to supply the power to the antenna. However, there has arisen a problem that since the band of the antenna itself is narrow, the power loss in the matching circuit increases to reduce the battery life of the portable terminal. That is, with respect to the conventional dielectric resonator antenna, the band of the antenna itself is narrow and, as a result thereof, there is a drawback that the loss in the matching circuit is large.

Further, since there is difficulty in realizing the efficient miniature antenna as described above, it is hard to adopt the structure of the array antenna or the like and, therefore, there is a problem that it is difficult to control the directivity of the portable terminal to thereby reduce the transmission power.

DISCLOSURE OF THE INVENTION

In view of the foregoing problems, it is an object of this invention to provide a miniaturizable antenna for a portable terminal at a low cost.

It is another object of this invention to provide a portable terminal that can reduce the transmission power to improve the battery life.

A specific object of this invention is to provide a dielectric resonator antenna that can be used as an antenna for a portable terminal, which is capable of lowering the consumption power by reducing a loss in a matching circuit.

It is another object of this invention to provide a dielectric resonator antenna that can prevent a reduction in efficiency when it is mounted to a portable terminal.

It is still another object of this invention to provide a dielectric resonator antenna that can realize low consumption power by giving directivity thereto.

It is another object of this invention to provide a method of designing a dielectric resonator antenna having a broad band.

According to this invention, there is provided an antenna being capable of reducing a loss in a matching circuit by broadening a band thereof. For this end, a resonator antenna of this invention has an electrode outside or inside an insulator material and emits a radio wave to the exterior by resonating a signal supplied into the insulator material from the electrode, and is characterized in that a relative permeability $\mu ra$ of the insulator material is $\mu ra>1$. Herein, the relative permeability being $\mu ra>1$ represents that the relative permeability $\mu ra$ is greater than 1 when a fraction below decimal point is rounded off.

On the other hand, when a first mode on the low frequency side and a second mode on the high frequency side at resonance peaks are observed as resonant modes of the antenna, the second mode becomes strong when $\mu ra$ is large, while, the first mode becomes strong when $\in ra$ is large. Therefore, it is preferable that $\mu ra$ and $\in ra$ be approximately equal to each other and it is more preferable that values of $\mu ra$ and $\in ra$ be adjusted so that the band can be broadened by superimposing the respective modes.

$\mu ra$ and $\in ra$ being approximately equal to each other in this invention represents that, as shown in FIG. 9, half frequencies of the resonance peaks of the first mode on the low frequency side and the second mode on the high frequency side are partly shared in frequency vs. antenna input impedance characteristics.

Further, the resonator antenna of this invention is characterized by being mounted on a conductive plate, operating as a reflecting plate, in a manner to contact therewith or via an insulator having a relative permittivity $\in ra>1$.

Further, the antenna with the reflecting plate of this invention is characterized in that, given that a relative permeability is $\mu rr$ and a relative permittivity is $\in rr$, a magneto-dielectric layer with $\mu rr \geqq \in rr$ is provided on a surface, opposite to an antenna mounting surface, of the reflecting plate.

A portable terminal of this invention is characterized by comprising the foregoing antenna and, particularly, it is preferable that a plurality of the foregoing antennas be mounted.

Hereinbelow, the operation of this invention will be described.

According to the resonator antenna of this invention, since the relative permeability $\mu ra$ of the dielectric (insulator) forming an antenna element is $\mu ra>1$, it is possible to increase a wavelength shortening coefficient $\sqrt{(\in ra \cdot \mu ra)}$ (note: since in-resonator wavelength $\lambda r=3\times10^8$ [m/s]/f [Hz]/$\sqrt{(\in r \cdot \mu r)}$ and space wavelength $\lambda 0=3\times10^8$ [m/s]/f [Hz], when the respective wavelengths are substituted for wavelength shortening coefficient=$\lambda 0/\lambda r$, the wavelength shortening coefficient can be derived as the square root of the product of the relative permeability and the relative permittivity) of an electromagnetic wave in the resonator and, as compared with the case where use is made of a general dielectric having $\mu ra=1$, the relative permittivity can be reduced. This makes it possible to reduce the impedance change at the time of resonance and thus realize broadening of the band of the antenna.

Although the ranges of the relative permittivity and the relative permeability are properly selected depending on communication frequencies, communication band, allowable component volumes, and so on, since the antenna gain is reduced when a short side of the antenna element becomes too small, they are preferably 200 or less and more preferably 100 or less, respectively. Further, as the wavelength shortening coefficient, referring to FIG. 10, since the frequency range of the portable terminal is 800 MHz to 5.2 GHz, it is 200 or less when the short side of the resonator is 1 mm, 100 or less when 2 mm, and about 50 to 3 when the short side of the resonator is set to about 5 mm or more for preventing the reduction in gain.

Further, according to the resonator antenna of this invention, the dielectric forming the antenna is mounted on a conductive plate in a manner to directly contact therewith or via an insulator with $\in rd>1$.

In this case, the mirror-image effect of an electric field can be utilized at the electric field symmetrical plane to thereby enable miniaturization of the antenna and, further, since the permittivity of the antenna itself can be reduced by the effect of the permeability, the impedance change at the time of resonance can be reduced to thereby enable broadening of the band.

Moreover, according to the antenna of this invention, the magneto-dielectric layer having a relationship of $\mu rr \geqq \in rr$ where $\in rr$ represents the relative permeability and $\in rr$ the relative permittivity, is provided on the surface, opposite to the antenna mounting surface, of the reflecting plate. Therefore, the mirror-image effect is produced with respect to a magnetic field, thereby enabling an improvement in reflection characteristics and thus in antenna gain. Therefore, the radio wave can reach a base station with small power so that the battery life of the portable terminal can be improved.

When the antenna of this invention is employed in the portable terminal, since the antenna element itself is broadband, it is possible to reduce the loss in the matching circuit and therefore improve the battery life of the portable terminal.

Further, when a plurality of antennas of this invention are employed in the portable terminal, since each antenna is highly efficient while being small in size, an array antenna can be efficiently formed so that the direction of the radio wave transmitted from the portable terminal can be controlled. Therefore, it is possible to suppress radiation of the radio wave in a direction opposite to the base station to thereby achieve the effective utilization of the power so that the battery life of the portable terminal can be improved.

BEST MODE FOR CARRYING OUT THE INVENTION

Embodiment 1

Figure 1:
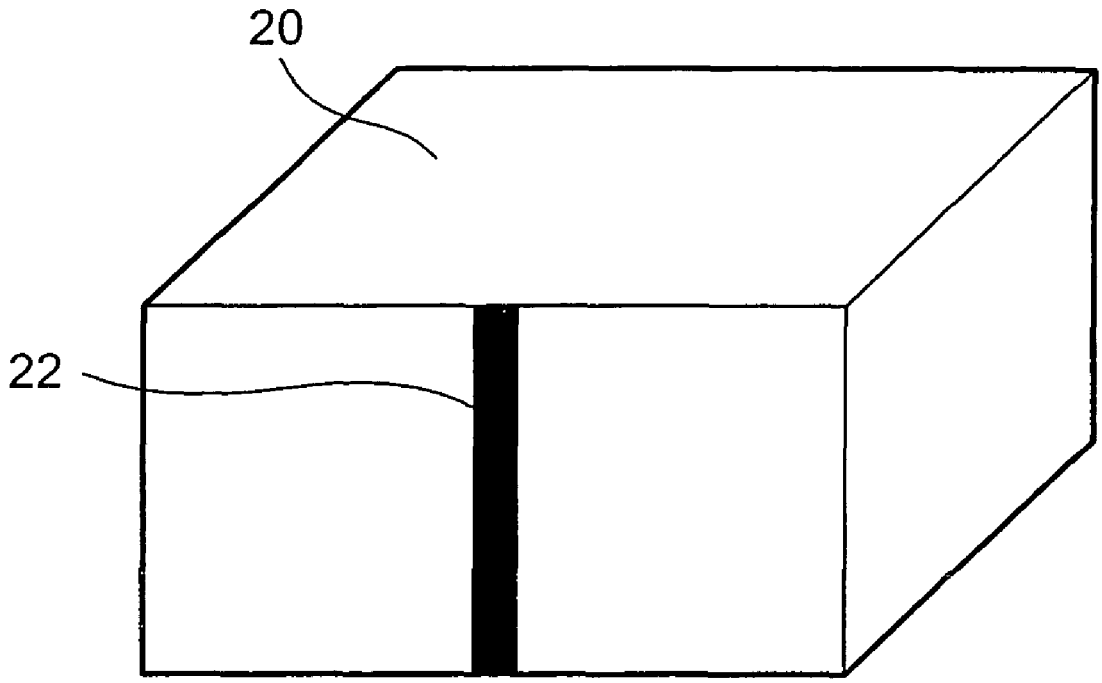
FIG. 1 is a schematic diagram showing a magneto-dielectric resonator antenna according to an embodiment 1 of this invention.

A resonator antenna according to an embodiment 1 of this invention will be described with reference to FIG. 1. FIG. 1 is a schematic diagram showing the resonator antenna according to the embodiment 1, wherein there are included a dielectric (insulator) 20 forming a resonator and a feeding electrode 22 for feeding the power to the resonator.

When manufacturing the illustrated magneto-dielectric 20, cobalt powder with a diameter of 50 nm and BST (barium strontium titanate) powder with a diameter of 0.5 μm were prepared and both powders were dispersed into an epoxy resin. In this case, 50 vol % cobalt and 10 vol % BST powder were dispersed with respect to the epoxy resin, then subjected to burning at 200° C. for one hour, and formed into a shape with a width of 14 mm, a length of 15 mm, and a thickness of 5.9 mm, thereby obtaining the illustrated dielectric 20. As a result of measuring the permittivity and permeability of this dielectric material by the cavity resonator method, $\in ra=11$ and $\mu ra=9$ so that a wavelength shortening coefficient of about 10 was obtained.

Then, by the use of silver paste, the feeding electrode 22 having a width of 0.5 mm was formed on a long-side surface of a rectangular parallelepiped by the photolithography method, thereby forming the magneto-dielectric antenna shown in FIG. 1.

Figure 2:
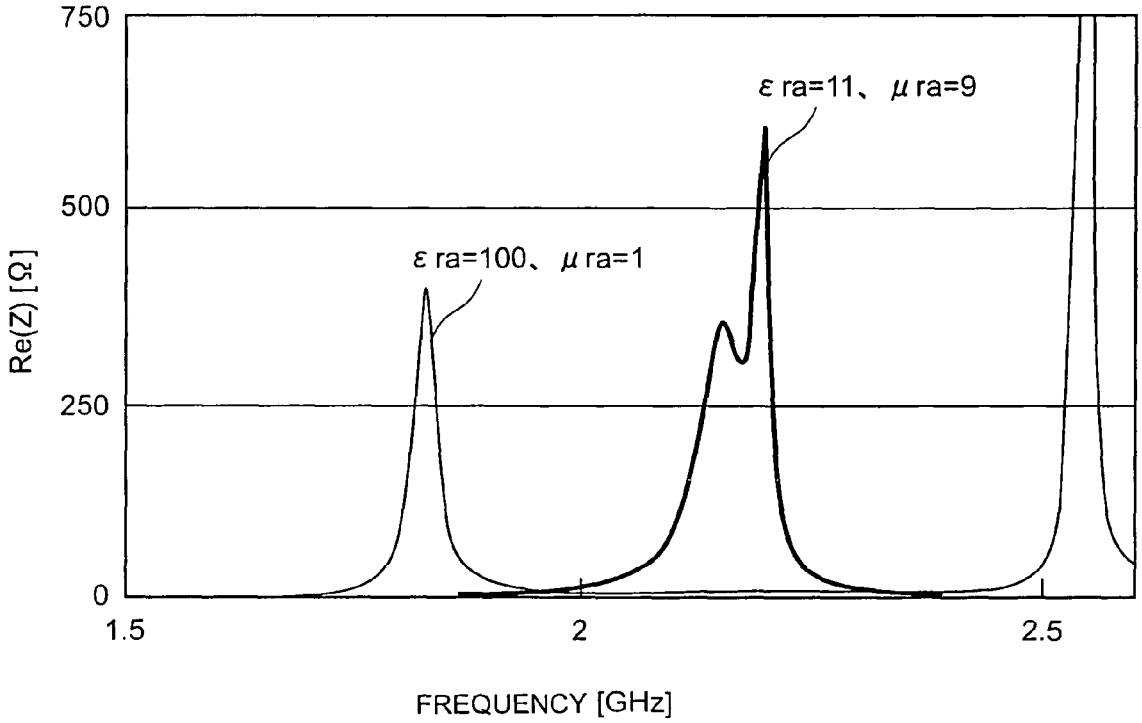
FIG. 2 is a characteristic diagram showing the input impedance of the magneto-dielectric resonator antenna with respect to signal frequency in the embodiment 1 of this invention.

FIG. 2 shows frequency characteristics of the impedance when a signal is supplied to the feeding electrode 22 by the use of a network analyzer. In FIG. 2, the real part of the input impedance is plotted against frequency and, for comparison, the impedance of an antenna of the same size made of BST ($\in ra=100$, $\mu ra=1$) is shown.

By the inclusion of the magnetic material, a resonant mode on the low frequency side and a resonant mode on the high frequency side were excited at substantially the same frequencies so that the band of the antenna was able to be broadened.

In order to understand the effect of this invention in more detail, cobalt powder and BST powder were dispersed into an epoxy resin in the ratio of 30 vol % and 20 vol %, respectively, thereby obtaining a magneto-dielectric 20 having $\in ra=20$ and $\mu ra=5$. Like in the case of the foregoing dielectric 20, a feeding electrode with a width of 0.5 mm was formed on this magneto-dielectric 20 by the use of silver paste, thereby obtaining a resonator antenna.

Figure 3:
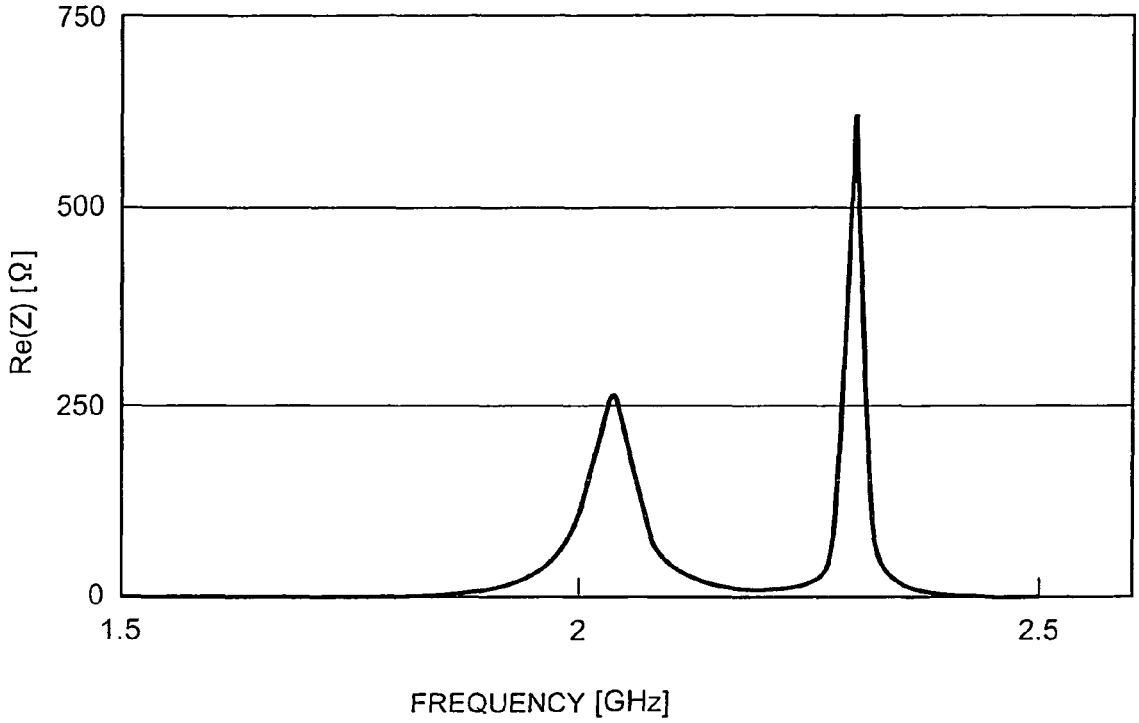
FIG. 3 is a characteristic diagram showing the input impedance of a magneto-dielectric resonator antenna with respect to signal frequency in the case where use is made of a magneto-dielectric having different composition components, in the embodiment 1 of this invention.

FIG. 3 shows characteristics of the real part of the input impedance of this resonator antenna with respect to frequency. It is understood that a resonant mode on the low frequency side and a resonant mode on the high frequency side exist in a separated state in terms of frequency. That is, it is understood that the resonant frequency can be controlled by controlling μra.

According to the resonator antenna of this invention using the magneto-dielectric, the resonator is made of the magneto-dielectric formed by mixing together the dielectric and the magnetic material, wherein the resonant frequency can be controlled by controlling $\in ra$ and μra and, further, the resonant modes can be superimposed by setting $\in ra$ and μra to be substantially equal to each other, thereby enabling the band of the antenna to be broadened.

Further, according to the resonator antenna of this invention, by introducing the magnetic material into the dielectric, the permittivity can be reduced and thus the Q value of the resonance can be lowered while maintaining the wavelength shortening coefficient given by $\sqrt{(\in ra \cdot \mu ra)}$, thereby enabling the band to be broadened.

Further, when the resonator antenna of this invention is mounted to a portable terminal, since the band of the antenna itself can be broadened, a loss in a matching circuit can be reduced so that it is possible to improve the battery life.

Embodiment 2

Figure 4:
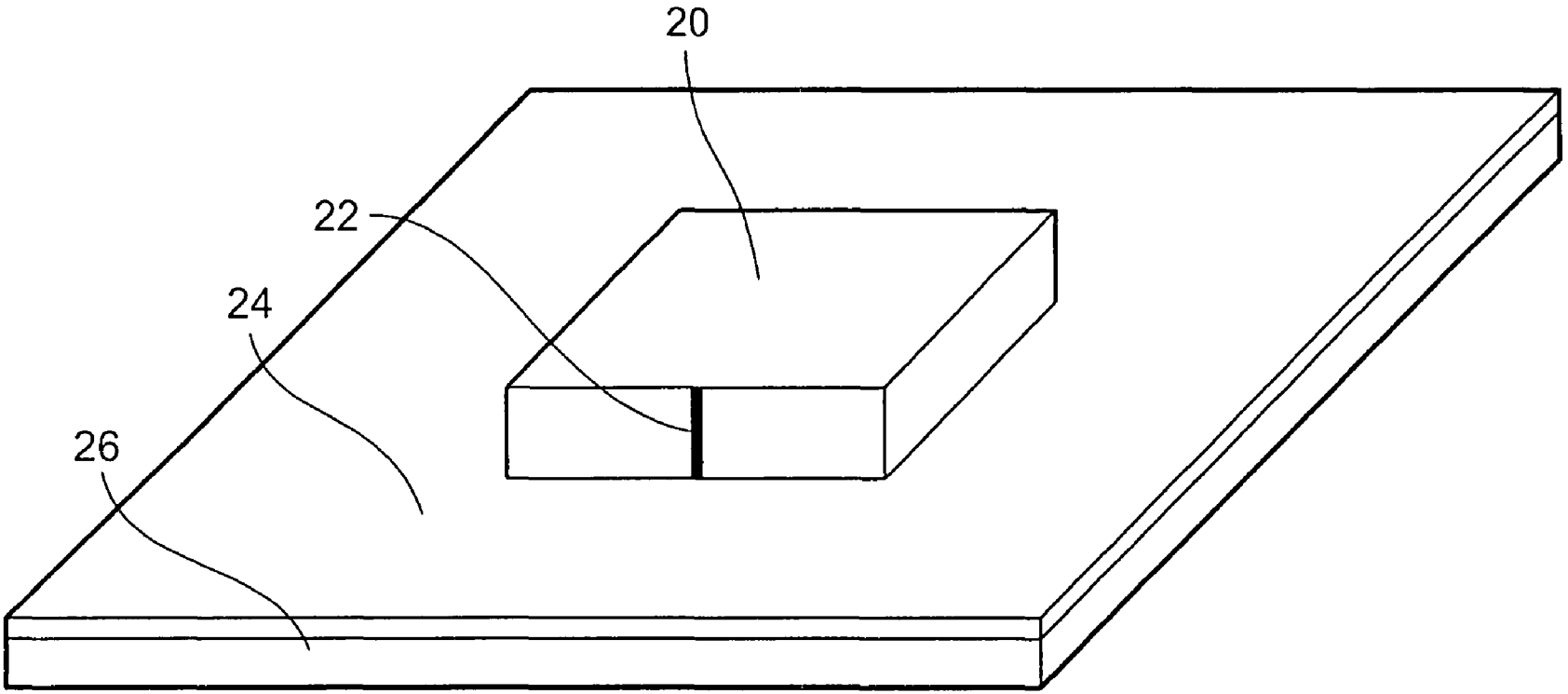
FIG. 4 is a schematic diagram showing a resonator antenna using a magneto-dielectric according to an embodiment 2 of this invention.

Referring to FIG. 4, description will be given of a resonator antenna using a magneto-dielectric in an embodiment 2 of this invention.

The resonator antenna according to the embodiment 2 shown in FIG. 4 comprises a resonator formed by a magneto-dielectric 20, which resonates a signal and emits it as a radio wave into the space, a feeding electrode 22 for feeding a signal to the resonator, a printed wiring board 24 for mounting thereon a body of the resonator, and a metal plate 26 which is located on a surface of the printed wiring board 24 on its side opposite to the antenna and terminates an electric field from the antenna so as to make a mirror image of the electric field. In this embodiment, a copper plate is used as the metal plate 26.

According to the same method as that in the embodiment 1, there was formed the resonator of the magneto-dielectric 20 having a width of 14 mm, a length of 15 mm, a thickness of 5.9 mm, $\in ra=11$, and $\mu ra=9$ and then the feeding electrode 22 with a width of 0.5 mm was formed by the use of silver paste. This antenna element was mounted at the center of the printed wiring board 24 having a width of 5 cm, a length of 5.3 cm, and a thickness of 0.1 mm and formed with a silver foil film having a thickness of 30 μm on the surface thereof opposite to its surface where the antenna was to be mounted.

Figure 5:
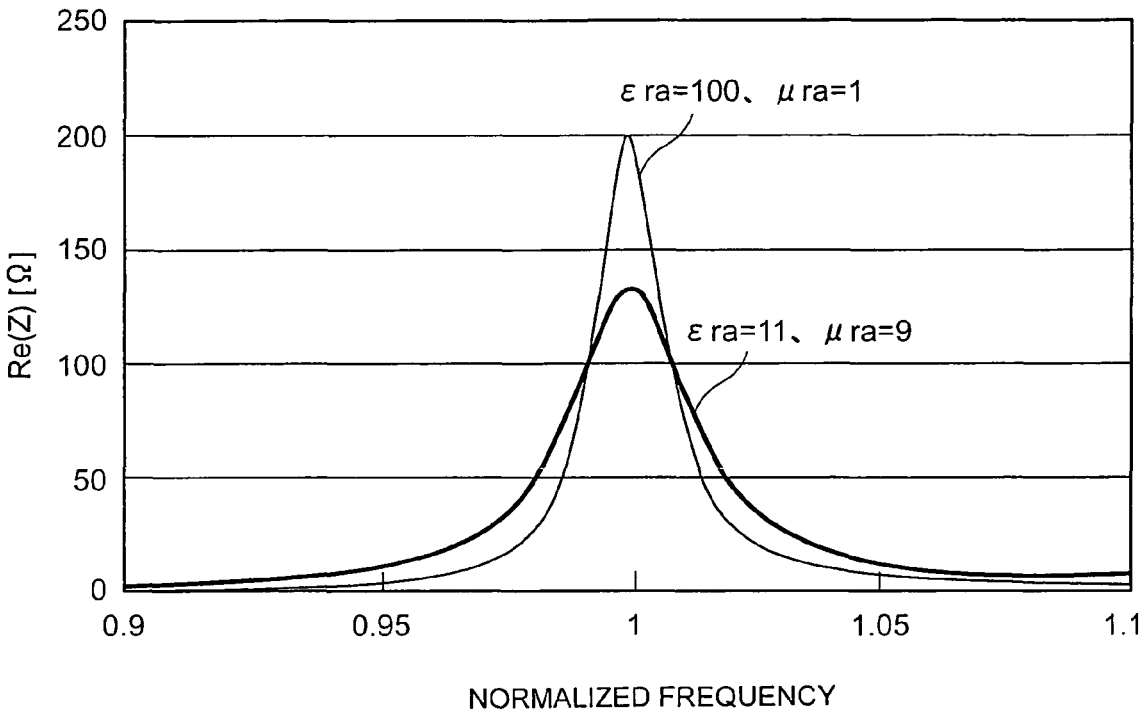
FIG. 5 is a characteristic diagram showing changes in real part of the input impedance with respect to normalized frequency normalized by a resonant frequency in the embodiment 2 of this invention.

FIG. 5 shows changes in input impedance, with respect to frequency, of the antenna mounted on the board having the metal reflecting plate 26 formed as described above. FIG. 5 shows changes in real part of the input impedance with respect to normalized frequency that was normalized by a resonant frequency, wherein there are shown, for comparison, relevant changes with respect to the resonator antenna (∈ra=100, μra=1) made of BST as described in relation to the embodiment 1, which is mounted on the same board.

As also clear from FIG. 5, it is understood that when the antenna of this embodiment is used, ∈ra can be reduced by the use of the magneto-dielectric and thus the Q value of the resonance can be lowered, thereby enabling the antenna band to be broadened.

According to the resonator antenna mounted on the board having the metal reflecting plate 26 in this embodiment, since the Q value of the resonance can be reduced even when mounted on the reflecting plate, the band can be broadened and, therefore, when it is mounted to a portable terminal, a loss in a matching circuit serving to broaden the band can be reduced so that it is possible to improve the battery life of the portable terminal.

Embodiment 3

Figure 6:
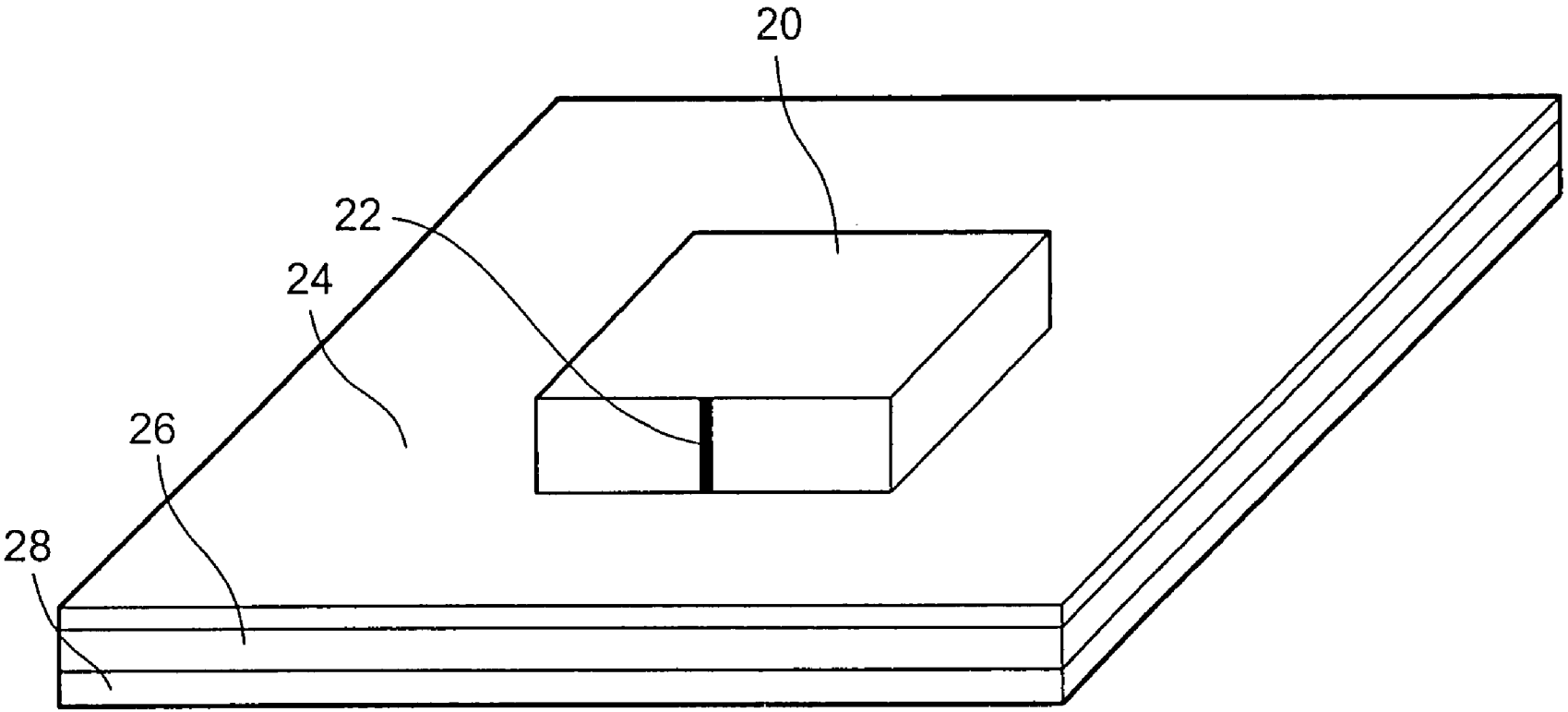
FIG. 6 is a schematic diagram showing a resonator antenna using a magneto-dielectric according to an embodiment 3 of this invention.

Referring to FIG. 6, description will be given of a resonator antenna using a magneto-dielectric in an embodiment 3 of this invention. The resonator antenna according to the embodiment 3 shown in FIG. 6 comprises a resonator formed by a magneto-dielectric 20, which resonates a signal and emits it as a radio wave into the space, a feeding electrode 22 for feeding a signal to the resonator, a printed wiring board 24 for mounting thereon a body of the resonator, and a magnetic layer 28 which is located at a surface of the printed wiring board 24 on its side opposite to the antenna and formed at the surface thereof opposite to its surface where the antenna is mounted.

Like in the embodiment 2, the resonator was formed by the magneto-dielectric 20 having a width of 14 mm, a length of 15 mm, a thickness of 5.9 mm, ∈ra=11, and μra=9. The magneto-dielectric 20 was mounted, as an antenna element, on the printed wiring board 24 having a width of 5 cm, a length of 5.3 cm, and a thickness of 0.1 mm. In this case, a copper foil film having a thickness of 30 μm had been formed on the surface, opposite to the antenna mounting surface, of the printed wiring board 24. By mounting the magneto-dielectric 20 at the center of the printed wiring board 24, the resonator antenna with the reflecting plate was formed. Further, on the surface, opposite to the antenna mounting surface, of the illustrated resonator antenna, the magnetic plate 28 having a relative permittivity of 4 and a relative permeability of 10 was formed to a thickness of 5 mm. In this case, the magnetic plate 28 was formed by dispersing cobalt powder with a diameter of 50 nm into an epoxy resin in the ratio of 50 vol % by the use of the solution cast method and then drying them at 200° C. for 30 minutes.

As a result of forming a thin film with a thickness of 5 mm under the same conditions as the forming conditions of the foregoing magnetic plate 28 and measuring its relative permittivity and permeability by the use of an impedance material analyzer, the subject magnetic plate 28 had a relative permittivity of 4 and a relative permeability of 10.

An evaluation was made of changes in input impedance of the thus formed antenna when mounted to a portable terminal. The antenna in the portable terminal was evaluated as changes in impedance depending on the presence of an influence of a human head. The evaluation results are shown in Table 1.

TABLE 1

| | Antenna alone | Human Head present (Interval to Antenna 10 mm) |
|---|---|---|
| Magneto-dielectric Resonator Antenna (with Magnetic Plate) (Embodiment 3) | 157.8-105.9i | 150.1-112.2i |
| Monopole Antenna | 109.1-39.5i | 180.5-14.8i |
| Magneto-dielectric Resonator Antenna (with Magnetic Plate) (Embodiment 2) | 108.7-68.6i | 98.6-107.6i |

Table 1 shows changes in impedance depending on the presence of the human head when the foregoing antenna was mounted to the portable terminal and, for comparison, also shows changes in impedance of a monopole antenna hitherto used in a portable terminal and of the resonator antenna with the reflecting plate shown in the embodiment 2. The measurement frequency was set to 2 GHz. It is understood that the impedance is reluctant to change even with the presence of the human head when the magnetic plate 28 is provided on the back side of the metal reflecting plate 26.

In the resonator antenna according to the embodiment 3, the input impedance is reluctant to be affected by the human head. Consequently, it was possible to reduce reflection of an input signal at the feeding electrode 22 caused by mismatching with a matching circuit and, as a result, it was possible to reduce a loss in the matching circuit.

Embodiment 4

Figure 7:
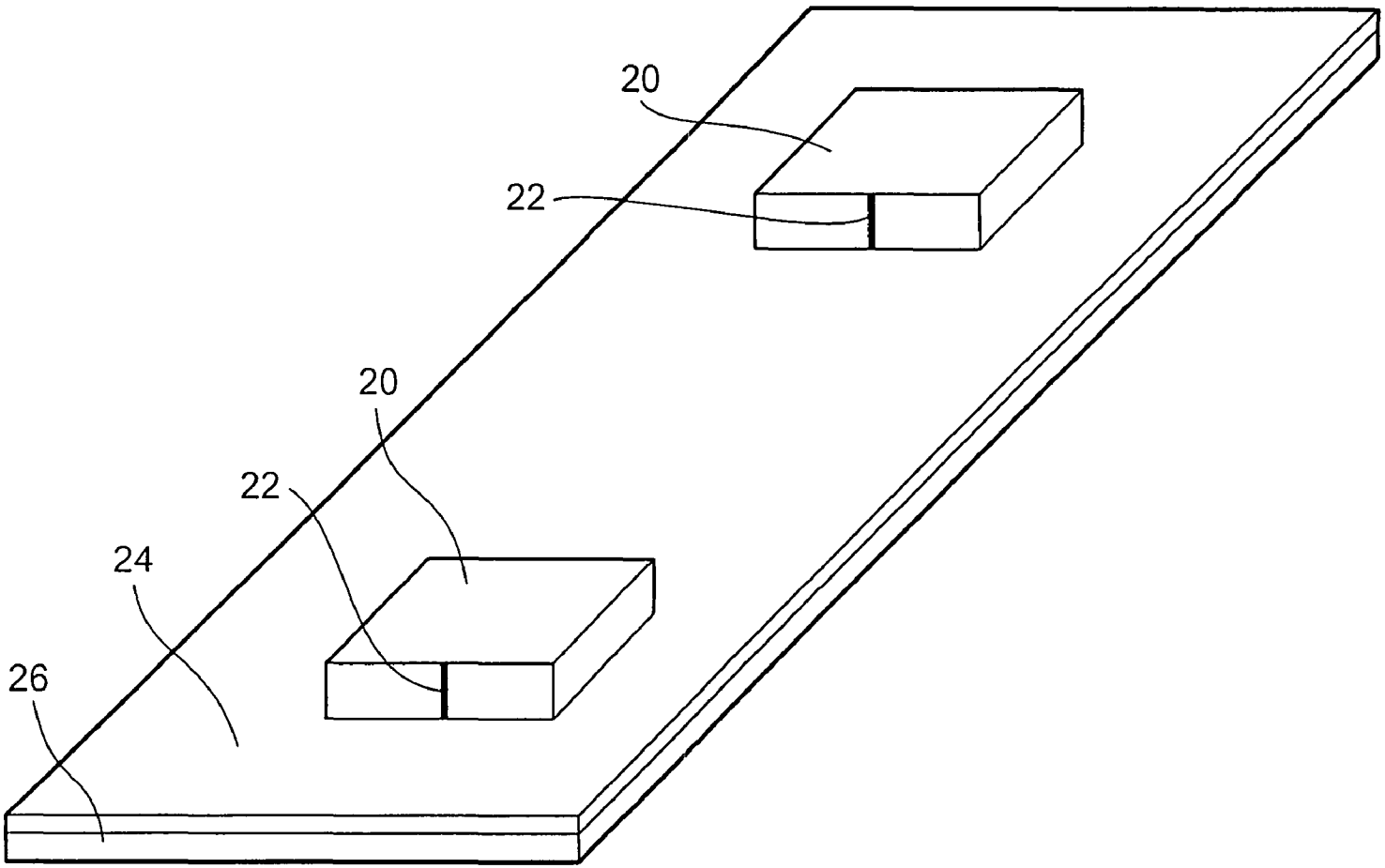
FIG. 7 is a schematic diagram showing a portable terminal in an embodiment 4 of this invention.

Referring to FIG. 7, description will be given of a portable terminal in an embodiment 4 of this invention. A portable terminal antenna according to the embodiment 4 shown in FIG. 7 is used as a signal transmission antenna of the portable terminal and, in this example, two antennas each with a reflecting plate, shown in the embodiment 2, are mounted. A rectangular board mounted thereon with the antenna comprises a printed wiring board 24 having a width of 5 cm and a length of 10 cm and a metal plate 26 provided on a surface of the printed wiring board 24 on its side opposite to an antenna mounting surface thereof. The two antenna elements each formed by a dielectric 20 and a feeding electrode 22 are disposed along a center line located at a distance of 25 cm from both short sides and at an interval of 5 cm from each other in a long-side direction.

Figure 8:
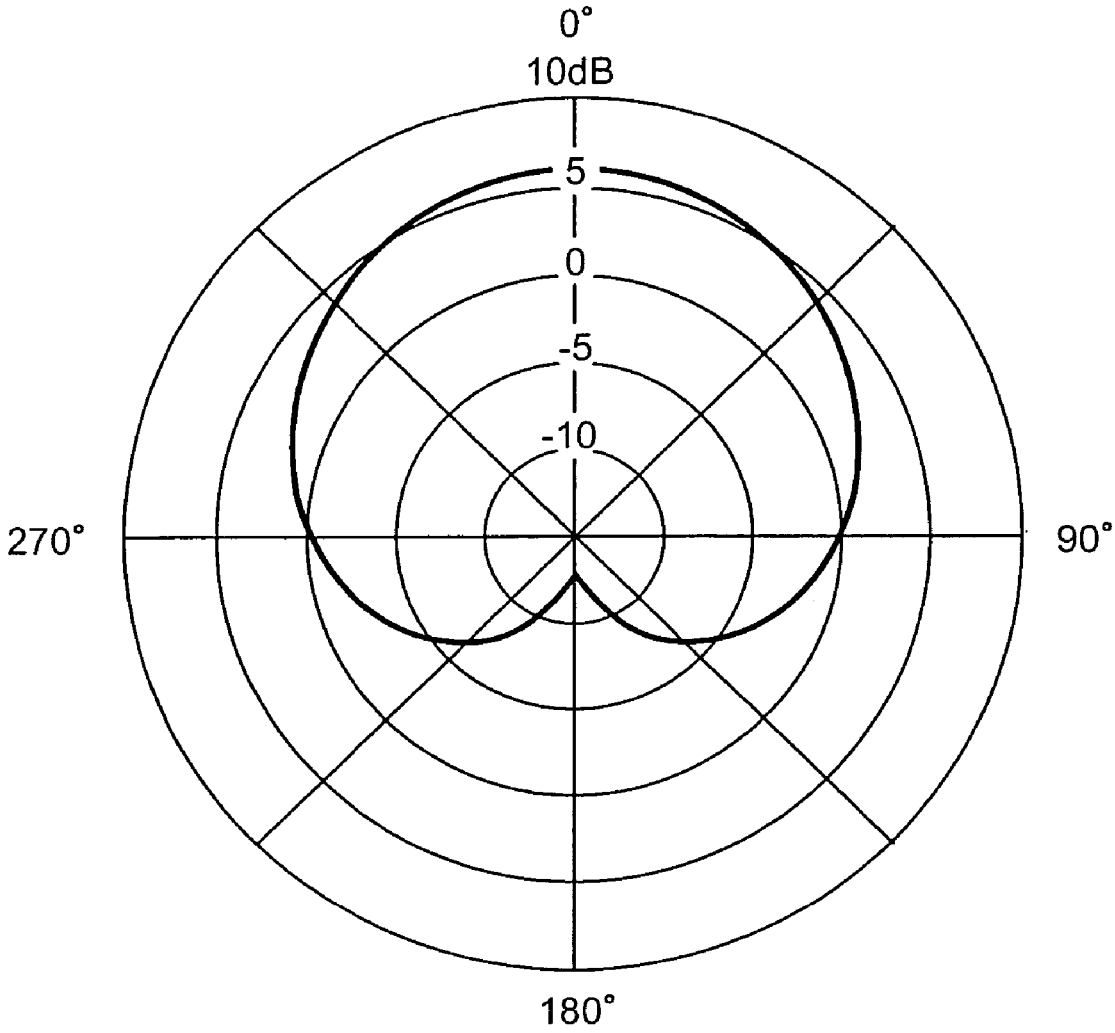
FIG. 8 is a characteristic diagram showing a radio wave radiation pattern of the portable terminal in the embodiment 4 of this invention.
Figure 9:
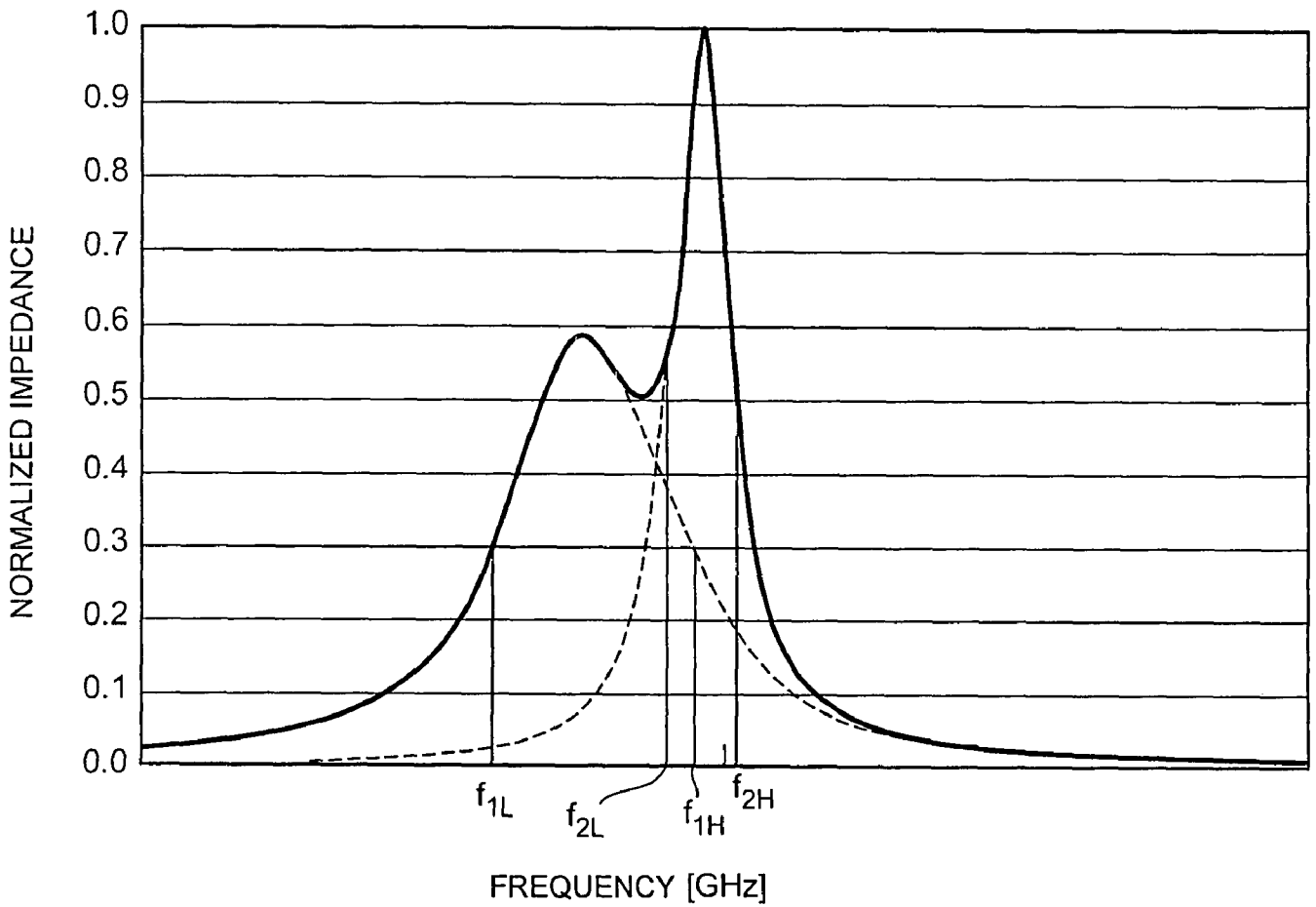
FIG. 9 is a characteristic diagram showing frequency vs. antenna input impedance characteristics in an antenna of this invention.
Figure 10:
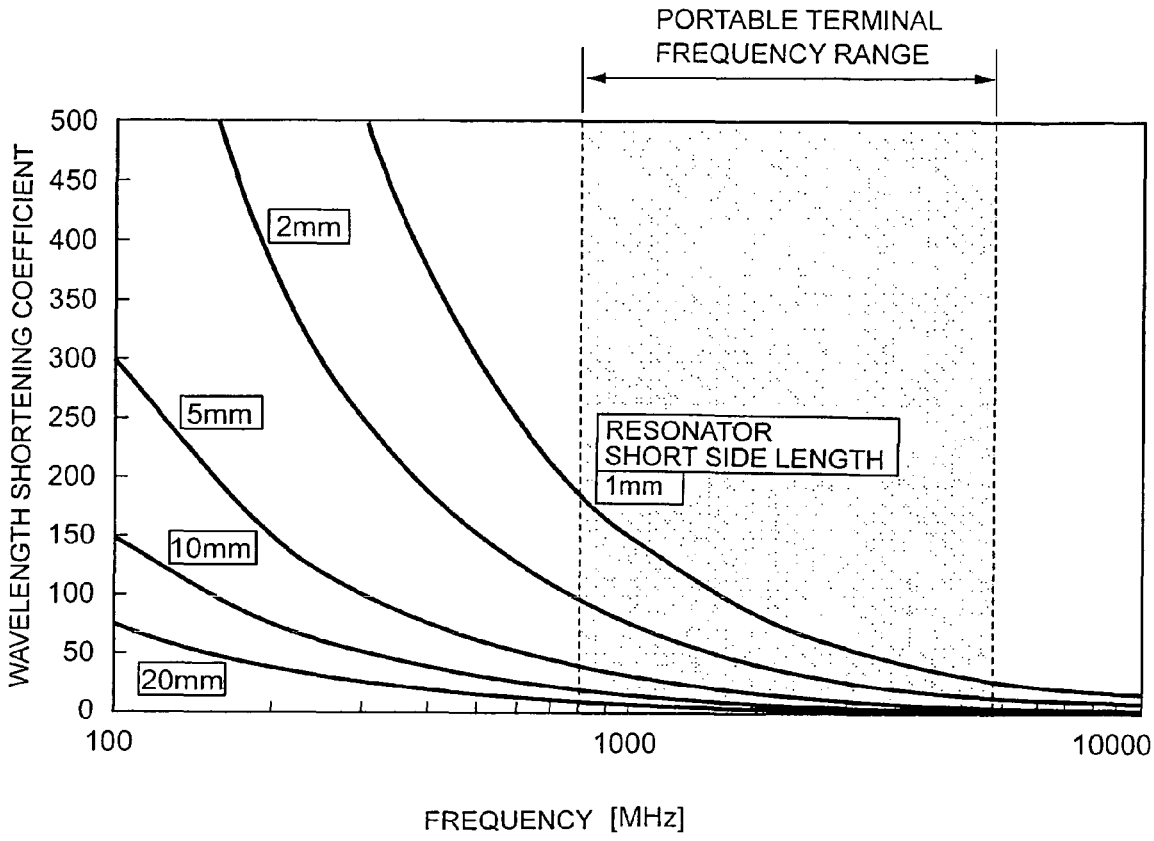
FIG. 10 is a diagram showing a relationship between frequency (MHz) and wavelength shortening coefficient, wherein there are shown wavelength shortening coefficients when the length of a short side of a resonator forming an antenna of this invention is changed.

FIG. 8 shows a radiation pattern when in-phase signals are supplied to the foregoing two antenna elements to cause them to perform the phased array operation. As shown in FIG. 8, the antenna of the embodiment 4 has directivity and, as compared with the case of the single antenna, it can improve the gain and control a radio wave radiation direction toward a base station direction. Therefore, the antenna shown in FIG. 7 does not transmit useless power into the space. As a result, it was possible to reduce the consumption power in the portable terminal to thereby improve the battery life.

The battery life improving effect in this embodiment is shown in Table 2.

TABLE 2

| | Battery Life |
|---|---|
| Portable Terminal in Embodiment 4 (Magneto-dielectric Resonator Antenna with Magnetic Layer) | 662 min. |
| Conventional Portable Terminal Monopole Antenna | 144 min. |

As also clear from Table 2, it is understood that the portable terminal according to the embodiment 4 of this invention is largely improved in battery life as compared with the conventional portable terminal. This shows that, by using the resonator antenna employing the magneto-dielectric like in this invention, the miniature broadband antenna with high efficiency was able to be formed because the Q value of the resonance did not increase even using the reflecting plate.

In the foregoing embodiments, the description has been given of only the example where cobalt is used as the magnetic material forming the magneto-dielectric 20. However, the magnetic material to be contained in the dielectric material may be a simple substance of cobalt, manganese, or iron, or an alloy or compound magnetic material containing at least one of cobalt, manganese, and iron. For example, there are cited an alloy of cobalt and iron, an alloy of a rare earth element and iron, ferrite, and so on. Further, these magnetic materials may be compounded or mixed together so as to be used. In the embodiments, the description has been given of the example where the dielectric material is obtained by dispersing the BST powder into the epoxy resin. However, as the dielectric material, a dielectric material having a desired permittivity can be properly selected and used, which may be mixed with the magnetic material. As the dielectric material, use may be made of, alone or in a mixed manner, organic materials (resin materials) such as, for example, liquid crystal resin, epoxy resin, olefin-based resin, fluororesin, BT (bismaleimide triazine) resin, and polyimide resin, or use may be made of, alone or in a compounded or mixed manner, inorganic materials such as silica ($SiO_2$, SiO), silicon nitride (SiN, $Si_3N_4$), zirconia (ZrO, $ZrO_2$), hafnia (HfO, $HfO_2$), titania (TiO, $TiO_2$), aluminum nitride (AlN), $SrBi_2Ta_2O_9$, $SrBi_2(Ta_{1-x},Nb_x)_2O_9$, and $Sr_2(Ta_{1-x},Nb_x)_2O_7$. As the inorganic dielectric material, use may also be made of, alone or in a compounded or mixed manner, high permittivity materials such as PZT (lead zirconate titanate), alumina ($Al_2O_3$), $BiTiO_3$, $SrTiO_3$, $PbZrO_3$, $PbTiO_3$, and $CaTiO_3$. The inorganic dielectric materials of the foregoing two examples may be used in a mixed manner, or the inorganic dielectric materials alone or in a compounded or mixed manner and the organic dielectric materials alone or in a mixed manner may be used in a mixed manner. The magnetic material is mixed into, preferably the fine powder of the magnetic material is dispersed into, the dielectric material to thereby obtain the magneto-dielectric. In this case, the relative permeability of the magneto-dielectric preferably exceeds 1 and is about 50 (preferably 15).

According to the resonator antenna of this invention, since the relative permeability μra of the insulator forming the antenna element is μra>1, it is possible to increase the wavelength shortening coefficient $1/\sqrt{(\in ra \cdot \mu ra)}$ of the electromagnetic wave in the resonator and, as compared with the case where use is made of the general dielectric having μra=1, the relative permittivity can be reduced. This makes it possible to reduce the impedance change at the time of resonance and thus realize broadening of the band of the antenna.

Further, according to the resonator antenna of this invention, since the antenna contacts with the conductive plate or is grounded via the insulator having ∈rd>1, the mirror-image effect of the electric field can be utilized at the electric field symmetrical plane to thereby enable miniaturization of the antenna and, further, since the permittivity of the antenna itself can be reduced by the effect of the permeability, the impedance change at the time of resonance can be reduced to thereby enable broadening of the band.

Moreover, according to the antenna of this invention, the magneto-dielectric layer having μrr≧∈rr where μrr represents the relative permeability and ∈rr the relative permittivity, is provided on the surface, opposite to the antenna mounting surface, of the reflecting plate so that the mirror-image effect is produced with respect to the magnetic field, thereby enabling the improvement in reflection characteristics and thus in antenna gain. Therefore, the radio wave can reach the base station with small power so that the battery life of the portable terminal can be improved.

When the antenna of this invention is employed in the portable terminal, since the antenna element itself is broadband, it is possible to reduce the loss in the matching circuit and therefore improve the battery life of the portable terminal.

Further, when a plurality of antennas of this invention are employed in the portable terminal, since each antenna is highly efficient while being small in size, the array antenna can be efficiently formed so that the direction of the radio wave transmitted from the portable terminal can be controlled. Therefore, it is possible to suppress radiation of the radio wave in a direction opposite to the base station to thereby achieve the effective utilization of the power so that the battery life of the portable terminal can be improved.

The invention claimed is:

1. A dielectric resonator antenna being adapted to emit a radio wave by resonating a signal, said dielectric resonator antenna comprising:

a conductive plate having a first and a second surface which are faced opposite to each other;

a dielectric placed opposite to said first surface of the conductive plate, said dielectric having a relative permeability (μra) of μra >1;

an electrode provided to said dielectric and adapted to be supplied with said signal; and a magneto-dielectric layer placed on said second surface of the conductive plate;

wherein said dielectric contains a magnetic material and a dielectric material to have frequency vs. antenna input impedance characteristics in which frequencies are partly superimposed in a half of resonance peak between a first mode on a low frequency side and a second mode on a high frequency side, and wherein said magneto-dielectric layer has a relative permeability (μrr) and a relative permittivity (∈rr), where μrr is not less than ∈rr, whereby said magneto-dielectric layer produces a mirror-image effect with respect to an electric field.

2. The dielectric resonator antenna according to claim 1, wherein said dielectric is mounted directly on said first surface of the conductive plate.

3. The dielectric resonator antenna according to claim 1, further comprising an insulator which is mounted on said first surface of the conductive plate and has a relatively permittivity (∈rd) of ∈rd>1, wherein said dielectric is mounted on said insulator.

4. The dielectric resonator antenna according to claim 1, wherein a wavelength shortening coefficient is 200 or less.

5. The dielectric resonator antenna according to claim 1, wherein a wavelength shortening coefficient is 100 or less.

6. The dielectric resonator antenna according to claim 1, wherein a wavelength shortening coefficient is 50 to 3.

7. The dielectric resonator antenna according to claim 1, wherein said magnetic material contains at least one of a simple substance of cobalt, manganese, or iron, and an alloy and a compound magnetic material each containing at least one of cobalt, manganese, and iron.

8. The dielectric resonator antenna according to claim 1, wherein said dielectric material contains one or both of a resin material containing at least one of liquid crystal resin, epoxy resin, olefin-based resin, fluororesin, BT (bismaleimide triazine) resin, and polyimide resin and an inorganic dielectric material containing at least one of silica ($SiO_2$, SiO), silicon nitride (SiN, $Si_3N_4$), zirconia (ZrO, $ZrO_2$), hafnia (HfO, $HfO_2$), titania (TiO, $TiO_2$), aluminum nitride (AlN), $SrBi_2Ta_2O_9$, $SrBi_2(Ta_{1-x},Nb_x)_2O_9$, $Sr_2(Ta_{1-x},Nb_x)_2O_7$, BST (barium strontium titanate), PZT (lead zirconate titanate), alumina ($Al_2O_3$), $BiTiO_3$, $SrTiO_3$, $PbZrO_3$, $PbTiO_3$, and $CaTiO_3$.

9. The dielectric resonator antenna according to claim 8, wherein fine powder of said magnetic material is dispersed into said resin material.

10. The dielectric resonator antenna according to claim 9, wherein said inorganic dielectric material is further dispersed into said resin material.

11. A portable terminal including the dielectric resonator antenna according to claim 1.

12. A portable terminal including a plurality of dielectric resonator antennas each according to claim 1 and being capable of adjusting a radio wave radiation direction.

13. A method of manufacturing a dielectric resonator antenna that emits a radio wave by radiating a radio wave to a resonator formed by a dielectric and resonating said radiated radio wave in said dielectric, said method comprising:

adjusting a relative permittivity on condition that a relative permeability exceeds 1, to thereby obtain a magneto-dielectric material that can achieve a predetermined wavelength shortening coefficient;

forming said dielectric by the use of said magneto-dielectric material, wherein said dielectric contains a magnetic material and a dielectric material to have frequency vs. antenna input impedance characteristics in which frequencies are partly superimposed in a half of resonance peak between a first mode on a low frequency side and a second mode on a high frequency side; and forming a magneto-dielectric layer having a relative permeability (μrr) and a relative permittivity (∈rr), where μrr is not less than ∈rr, whereby said magneto-dielectric layer produces a mirror-image effect with respect to an electric field, wherein said magneto-dielectric material is produced by mixing together the magnetic material and the dielectric material.

14. A method of manufacturing a dielectric resonator antenna that emits a radio wave by radiating a radio wave to a resonator formed by a dielectric and resonating said radiated radio wave in said dielectric, said method comprising:

adjusting a relative permittivity on condition that a relative permeability exceeds 1, to thereby obtain a magneto-dielectric material that can achieve a predetermined wavelength shortening coefficient;

forming said dielectric by the use of said magneto-dielectric material, wherein said dielectric contains a magnetic material and a dielectric material to have frequency vs. antenna input impedance characteristics in which frequencies are partly superimposed in a half of resonance peak between a first mode on a low frequency side and a second mode on a high frequency side; and forming a magneto-dielectric layer having a relative permeability (μrr) and a relative permittivity (∈rr), where μrr is not less than ∈rr, whereby said magneto-dielectric layer produces a mirror-image effect with respect to an electric field.

15. The method according to claim 14, wherein said magnetic material contains at least one of a simple substance of cobalt, manganese, or iron, and an alloy and a compound magnetic material each containing at least one of cobalt, manganese, and iron.

16. The method according to claim 14, wherein said dielectric material contains one or both of a resin material containing at least one of liquid crystal resin, epoxy resin, olefin-based resin, fluororesin, BT (bismaleimide triazine) resin, and polyimide resin and an inorganic dielectric material containing at least one of silica ($SiO_2$, SiO), silicon nitride (SiN, $Si_3N_4$), zirconia (ZrO, $ZrO_2$), hafnia (HfO, $HfO_2$), titania (TiO, $TiO_2$), aluminum nitride (AlN), $SrBi_2Ta_2O_9$, $SrBi_2(Ta_{1-x},Nb_x)_2O_9$, $Sr_2(Ta_{1-x},Nb_x)_2O_7$, BST (barium strontium titanate), PZT (lead zirconate titanate), alumina ($Al_2O_3$), $BiTiO_3$, $SrTiO_3$, $PbZrO_3$, $PbTiO_3$, and $CaTiO_3$.

17. The method according to claim 16, further comprising dispersing fine powder of said magnetic material into said resin material.

18. The method according to claim 17, further comprising dispersing said inorganic dielectric material into said resin material.

* * * * *